United States Patent [19]

Hobson et al.

[11] Patent Number: 4,786,320

[45] Date of Patent: Nov. 22, 1988

[54] METHOD AND APPARATUS FOR REMOVAL OF GASEOUS, LIQUID AND PARTICULATE CONTAMINANTS FROM MOLTEN METALS

[75] Inventors: David O. Hobson; Igor Alexeff, both of Oak Ridge; Vinod K. Sikka, Clinton, all of Tenn.

[73] Assignee: The United States of America as represented by the Deprtment of Energy, Washington, D.C.

[21] Appl. No.: 83,482

[22] Filed: Aug. 10, 1987

[51] Int. Cl.[4] ..... C22B 4/00; C22B 7/00

[52] U.S. Cl. ..... 75/10.65; 75/63

[58] Field of Search ..... 75/10.65, 63

[56] References Cited

U.S. PATENT DOCUMENTS

| | | | |
|---|---|---|---|
| 3,160,497 | 12/1964 | Loung | 75/10.65 |
| 3,672,872 | 6/1972 | Bonnier | 75/63 |
| 3,734,720 | 5/1973 | Starck | 75/63 |
| 4,582,531 | 4/1986 | Yoshii | 75/10.15 |

OTHER PUBLICATIONS

Igor Kirko, "Magnetohydrodynamics of Liquid Metals", Consultants Bureau, New York, 1965.

H. Branover, "Magnetohydrodynamic Flows and Turbulence: A Report on the Third Beer-Sheva Seminar", J. Fluid Mech. (1981), vol. 112, pp. 487-497.

U. Andres, "Magnetohydrodynamic & Magnetohydrostatic Methods of Mineral Separation", John Wiley & Sons, New York.

P. Marty, "Theoretical and Experimental Aspects of Electromagnetic Separation", Institut de Mecanique de Grenoble, France.

*Primary Examiner*—Peter D. Rosenberg

*Attorney, Agent, or Firm*—Stephen D. Hamel; Judson R. Hightower

[57] ABSTRACT

Method and apparatus for removal of nonelectrically-conducting gaseous, liquid, and particulate contaminants from molten metal compositions by applying a force thereto. The force (commonly referred to as the Lorentz Force) exerted by simultaneous application of an electric field and a magnetic field on a molten conductor causes an increase, in the same direction as the force, in the apparent specific gravity thereof, but does not affect the nonconducting materials. This difference in apparent densities cause the nonconducting materials to "float" in the opposite direction from the Lorentz Force at a rapid rate. Means are further provided for removal of the contaminants and prevention of stirring due to rotational forces generated by the applied fields.

6 Claims, 3 Drawing Sheets

METHOD AND APPARATUS FOR REMOVAL OF GASEOUS, LIQUID AND PARTICULATE CONTAMINANTS FROM MOLTEN METALS

BACKGROUND OF THE INVENTION

1. Field of the Invention

The present invention relates to methods and apparatus for removing contaminants from molten metal compositions, and more particularly, to a method and apparatus for removing gaseous, liquid and particulate contaminants from molten metal compositions. It is made in the course of a contract with the U.S. Department of Energy.

2. Discussion of Related Art

In general, raw metallic materials which are processed for commercial use are initially converted to metallic melts and cast. The raw metallic materials referred to hereinabove may be ores and oxides as well as particulates.

Metallic ores include elemental materials which are obtainable by a mining operation.

Metal oxides include compound forms of a metal combined with oxygen, which exist in both natural forms and man-made forms. Natural metallic oxides include those naturally occurring and are commonly derived from metallic ores. Man-made oxides include by-products and waste materials which result from metallurgical type operations.

Metal particulates include by-product or waste metal fragments from various types of metal operations and may, for exemplary purposes only, consist of borings, punchings, shredded pieces, crushed turnings, clippings, shavings, and the like.

The term "metallic melt" may be equated to "molten metal", and is referred to herein as a metal which had been converted from a solid form to a molten form by subjecting the solid form to at least a temperature which imparts sufficient kinetic energy to the molecules thereof so as to cause the molecules to overcome their crystal binding forces.

One of the usual commercial methods for reducing and isolating elements of the raw metallic materials is a thermal method. Typically a thermal method comprises heating the raw metallic materials in contact with certain compounds or fluxes which contain one or more elements having a strong chemical affinity for a substance normally combined with a metal or the raw metallic material. During the course of the method, when a sufficiently high temperature is reached, the raw metallic material dissociates and the non-metallic portion forms new compounds with the elements present in the flux, thus leaving the then isolated metal in an approximately pure state.

As referenced above, almost all metals and alloys of commercial use have a melting and casting process as one step in their fabrication path. Both steel, aluminum and alloys thereof are good, but not exclusive, examples. Steel, for example, is melted and cast commercially in continuous casting machines at a rate of 200–300 tons/h. Great care is taken to protect the steel from various interactions as it flows from the ladle to the tundish to the mold proper, through silica or alumina/graphite tubes. Despite these precautions, various contaminants still enter and are incorporated into the cast steel. Commercial steelmaking procedures utilize a number of metallic additions to "kill" or deoxidize molten steel. These include aluminum, calcium-silicon mixtures, ferrosilicon, ferromanganese, zirconium, titanium, and other oxygen scavengers. Some of the compounds formed with oxygen are solid at ladle temperatures and some are liquid. An example of such molten steel deoxidation is described in British Patent No. 1,472,537. Particularly, the British Patent discloses a method for deoxidizing molten steel which comprises adding thereto a mixture of aluminum oxide and metallic aluminum. However, the method was later discovered to be unsatisfactory. Alumina combined with the steel which adversely affected the properties of the finished steel product. As to the inherent presence of nitrogen and sulfur impurities, other reactants were combined therewith to form compounds, which in most cases, are able to float to the top of the melt in the ladle or tundish and be incorporated into the slag layer for discard. It is well-known that during metallurgical treatment of molten metal compositions, an exchange of materials occur between the molten metal composition and the slag which is floating thereon. In most cases, the slag contains a material which reacts with some but not all of the impurities contained in the molten metal composition and wherein the reaction products are absorbed by the slag. Another method of degassing comprises passing the molten metal composition through an evacuation chamber wherein the gases are withdrawn resulting in an improvement of the quality of the metal. However, as further discovered, degassing methods do not adequately eliminate the impurities.

As is evident from the foregoing, contaminants are still present even after molten metal compositions, such as a molten steel composition, have been subjected to any one of the aforementioned processes. In the case of a molten steel composition, the remaining contaminants, plus those formed by reoxidation of the pouring streams, end up in the cast steel thereby degrading the steel quality.

Japanese Patent No. 50,432/1979 describes a technique whereby ceramic fingers are immersed in a molten steel composition to collect contaminants. However, this approach has drawbacks in that it introduces foreign material into the melt and suffers from surface saturation effects. Ceramic foams have served as filters with success in the aluminum industry, but with almost no success in the steel industry. This technique again, depends on adsorption and sintering of contaminants to the ceramic. Foam fragility is a recurrent problem. The conclusion that can be reached from the foregoing is that no satisfactory technique currently exists for removing any of the common inclusions.

SUMMARY OF THE INVENTION

Therefore it is the primary object of the present invention to provide an improved method for removal of impurities from a molten metal composition.

Another object of the present invention is to provide a means for removal of gaseous, liquid, and particulate contaminants from a molten metal composition.

Yet, a further object of the present invention is to provide a means for removing contaminants from a flowing steel composition stream.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The foregoing objects and others are accomplished in accordance with the present invention, generally speaking, by providing a method for removing contaminants from a molten metal composition, said contaminants being characterized with having less electrical conductivity than the molten metal and preferably nonelectrically-conducting gaseous, liquid, and particulate contaminants from molten metal compositions which comprises applying a magnetic field to a molten metal composition and, simultaneously, applying an electric current to the molten metal composition in a direction perpendicular to the magnetic field lines to impose a force (the Lorentz force) on the molten metal component of the composition, thereby increasing its apparent density in the direction of the force, causing the less electrically conducting contaminants, preferably the nonconducting contaminants contained in the composition to move in a direction opposite to the force on the molten metal. These applied method steps cause the contaminants to be concentrated in a particular, small volume of the molten metal composition, which, in turn, are then subjected to a removal means.

In a further embodiment of the present invention an apparatus is provided comprising a device which includes a body of generally toroidal configuration having an outer wall with inlet and outlet ends adapted to receive and discharge a stream of molten metal composition, and an electromagnet having pole faces for coupling to the body so as to provide a magnetic field through the toroidal cavity while an electric current is simultaneously induced perpendicular to the induced magnetic field which imposes a force on the molten metal component of the composition that increases the apparent density thereof. As a result, the contaminants contained in the composition are moved in a direction opposite the force.

BRIEF DESCRIPTION OF THE DRAWINGS

The present invention will become more fully understood from the detailed description given hereinbelow and the accompanying figures which are given by way of illustration only, and thus are not limitative of the present invention, and wherein.

DETAILED DESCRIPTION OF THE INVENTION

A magnetic field will impose a force (the Lorentz Force) upon the electrons moving in a conductor within that field. This force, seen as being applied to the conductor, is always at right angles to the plane containing the magnetic flux direction and the current flow direction as illustrated below.

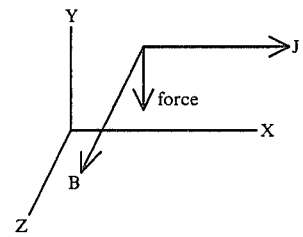

The magnitude of the force is:

$$\vec{F}(N/m^3)=\vec{B}(Wb/m^2\times\vec{J}(A/m^2).$$

where:

$\vec{F}$=force, in Newtons per cubic meter of conductor $\vec{B}$=magnetic flux, in Webers per square meter $\vec{J}$=current, in amperes per square meter.

It is known that the buoyancy force propelling a lighter body through a denser liquid is proportional to the density difference between them. This force is opposed by the forces due to liquid viscosity and drag on the particle due to its shape. As particle size decreases, the velocity of the particle also decreases. As an example, suppose small spheres of polypropylene, a plastic with a specific gravity of 0.90 g/cc, are dispersed into water. They will float to the top very slowly, driven by the slight difference in density and retarded by the viscous drag. Now, disperse the same spheres in mercury (specific gravity=13.5 g/cc). They will pop to the surface in a fraction of a second, driven by the enormous density difference.

The present inventors propose a device that will use a known phenomenon, the Lorentz force, to increase the apparent specific gravity of liquid steel (acting as a conductor) while the nonconducting contaminants are not affected. The net effect will be for the particles to "float" in the opposite direction from the Lorentz force at a much faster rate than they would normally attain. The present inventors expect the contaminant particles to migrate through the liquid conductor to the wall of the container in a time period less than that needed for the liquid to pass through the device.

The present inventors have demonstrated the present invention in both a dc and an ac magnetic field, each having the desired effect of stimulating separation between the conducting and nonconducting material. The preferred embodiment uses an ac magnet since the ac current can also be induced by the ac magnetic field.

Figure 1A:
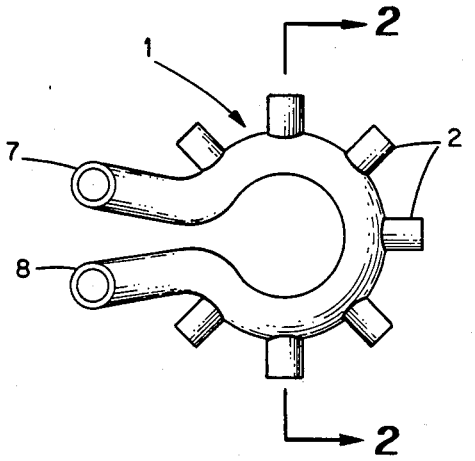
FIGS. 1*a* and 1*b* show a Pyrex separator designed to demonstrate the present invention.
Figure 1B:
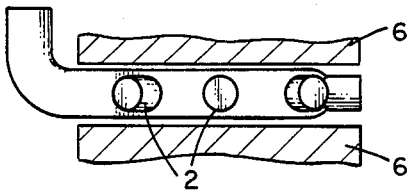
Figure 2A:
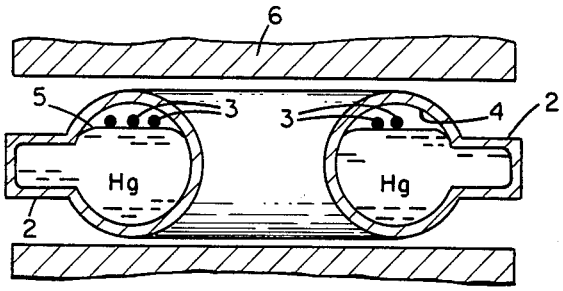
FIGS. 2*a* and 2*b* are enlarged cross sectional views taken at 2—2 in FIG. 1*a;*
Figure 2B:
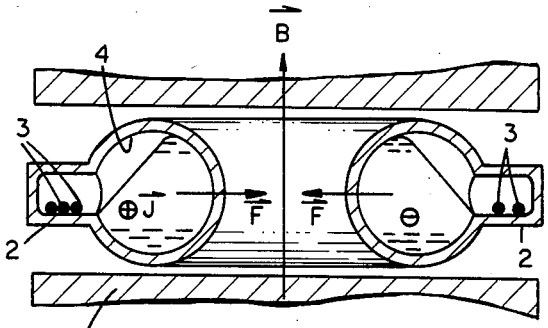

The device shown in FIGS. 1 and 2 is an early embodiment of the separator concept. It is included to illustrate the forces involved in the invention. The pyrex tube 1 is formed into an almost complete torus with two open ends turned up to receive appropriate electrodes. Pockets 2 are located horizontally into the outer periphery of the tube. The tube and pockets are partially filled with mercury and a number of glass beads 3 are distributed on the surface of the mercury, as shown in FIG. 2*a*. The device is placed between the horizontal faces of a d.c. electromagnet (not shown) and current leads are inserted through the ends of the tube 1 to contact the mercury and a d.c. current flows unidirectionally around the torus. The current density, $\vec{J}$, and the magnetic field, $\vec{B}$, are crossed, as shown in FIG. 2*b*, to produce the radially inward force $\vec{F}$ on the mercury. Application of the current and the magnetic field produced a movement of the mercury toward the center of the torus and a tilt of the mercury surface. A tilt of approximately 45 degrees was achieved at very low values of $\vec{J}$ and $\vec{B}$. At this angle the force $\vec{F}$ was equal to the accelerative force of gravity. It was obvious that much higher forces could be applied.

Figure 3:
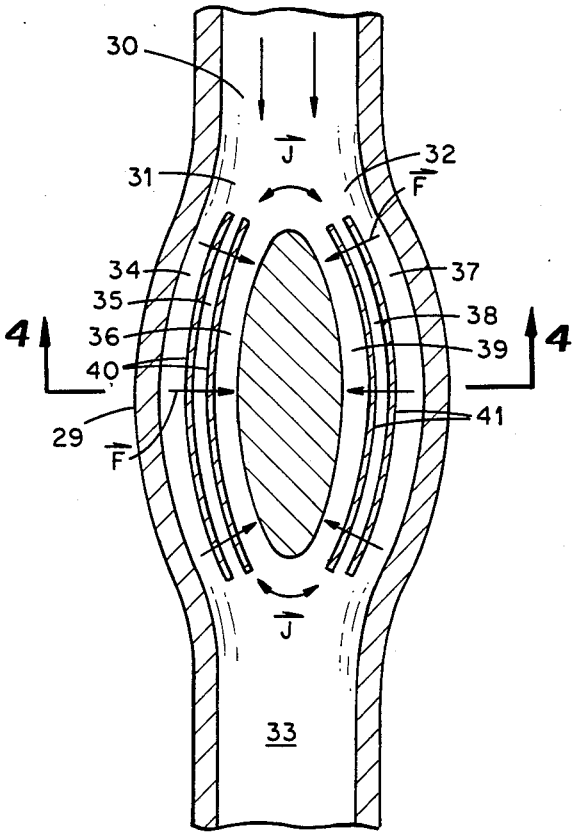
FIG. 3 is a sectional view of a conceptual modular device for removal of gaseous, liquid, and particulate materials from molten metals in accordance with the present invention.
Figure 5:
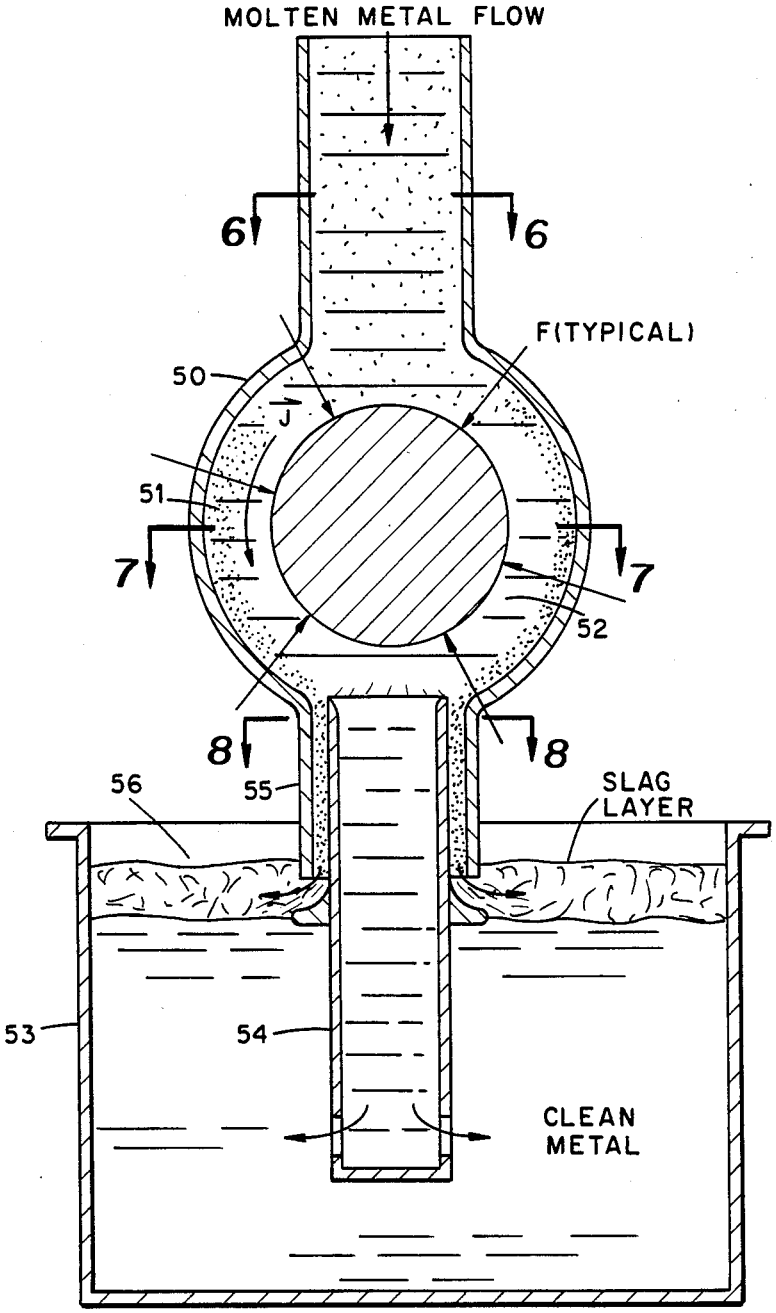
FIG. 5 is a sectional view of another conceptual modular device in accordance with the present invention.
Figure 6:
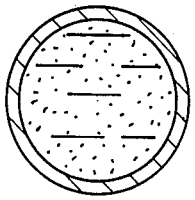
FIG. 6 is a cross sectional view taken along 6—6 in FIG. 5.

When the nonconducting contaminants of the present invention are concentrated in a particular, small volume of the molten metal, the nonconducting contaminants are preferably removed by adsorption on the ceramic baffles, as shown in the embodiment of FIG. 3, or are skimmed off into the slag layer by the shroud tube, as shown in FIG. 5.

PREFERRED EMBODIMENTS

The following examples illustrate the present invention in detail:

EXAMPLE I

The present invention is demonstrated by using mercury to simulate a molten metal. A glass bubble is filled with mercury and used as the nonconducting object which is incorporated into the mercury pool (very few metals sink in mercury). The glass stem on the sphere which projects above the mercury, provides sufficient additional force to sink the sphere. An ac electromagnet is used to provide the magnetic field, and an ac current was induced in the mercury by another electromagnet. Since the magnetic field and the induced current must be in phase, and since the induced current is induced 90° out of phase with the applied voltage, a two-phase ac power supply was used. The magnetic field was estimated to be one kilogauss and the ac current, one thousand amperes. On energizing the electric circuits, the glass-coated mercury ball was observed to rise to the surface.

In a second experiment, utilizing a dc magnet and dc source, the glass ball was ejected from the mercury with such force that it was broken.

EXAMPLE II

In another experiment, the present invention was studied using an unclosed Pyrex torus as shown in FIGS. 1 and 2. The torus was filled, in a horizontal position, (FIG. 2*a*) with mercury to within 5 mm of its top inner surface 4 and numerous 3 mm-dia. glass beads 3 were distributed over the mercury surfaces as shown in FIG. 2*a*. The torus was then placed between the horizontal faces of a 10-kilogauss dc electromagnet 6 while electrical leads from a dc power supply (not shown) were inserted into the open ends 7, 8 (FIG. 1*a*) to contact the mercury. The object of this experiment was to cause the mercury to react to the Lorentz force, directed radially inward, and cause the glass spheres 3 to move to the outer circumference and into the outer pockets 2 as shown in FIG. 2*b*. The experiment was successful and the results are as illustrated in FIG. 2. The diagram of FIG. 2 illustrates the effect of combined electrical and magnetic forces on mercury conductor. (a) Experiment with no applied current, J, or magnetic field, B. (b) Experiment with J=10 A and B=7 kilogauss applied. Note migration of mercury toward inner surface of torus and movement of beads 3 into pockets 2.

Having demonstrated the feasibility of the present invention, the present inventors propose to utilize the principles described above to form a regime through which a stream of molten metal passes and within which the metal is acted upon by forces several times normal gravity (one small-scale experiment produced a force of seven times the force of gravity) so as to force lighter, nonconducting (or lower conductivity) species in an opposite direction, onto an adsorbing surface or else into a diverter for redirection into the slag layer. It is known that baffles, particularly baffles having certain ceramic surfaces comprised of a material capable of absorbing contaminants with less electrical conductivity than the molten metal from a molten metal composition, such as $Al_2O_3$, $SiO_2$, are receptive to the deposition and buildup of various contaminants from the molten metal. Commercially, such buildups can, over a period of time, cause plugging in shroud tubes, sliding gate valves, and other parts of the pouring circuit. The device of the present invention will capitalize on this propensity and will feature quick removal and replacement as plugging occurs.

Figure 4:
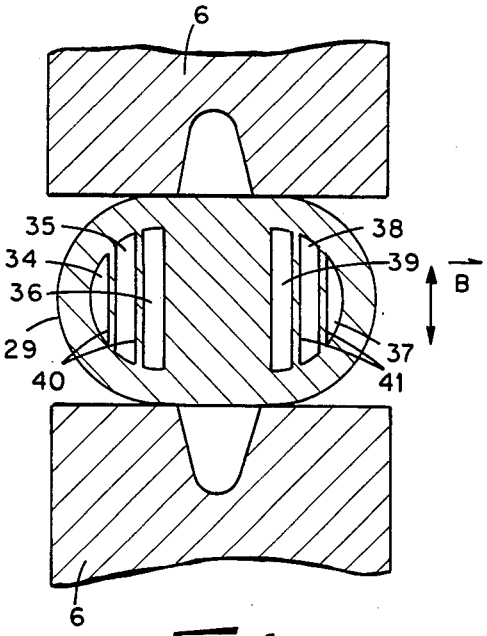
FIG. 4 is a cross sectional view taken along 4—4 in FIG. 3.

FIGS. 3 and 4 illustrate a generic form of the device 29 of the present invention with the following features: (a) the device 29 fits between, and is easily removable from, the poles 6 of an ac electromagnet (FIG. 4) that not only supplies an alternating B field for the device but also induces an alternating current, J, in a toridal path within the device; (b) the B field and the current J alternate in such a way that the force $\vec{F}$ is always directed inward; (c) the molten metal inlet flow path 30 is split smoothly and directed into two paths 31, 32 for current flow considerations. These paths recombine at the outlet 33 of the device; (d) each path 31, 32 is further divided into narrow paths 34–39 by adsorbing partitions 40, 41 which reduce the migration distance of the contaminants. The contaminant particles are adsorbed and held on partitions 40, 41 until the flow path becomes plugged at which time it is removed and replaced; (e) the device 29 can be quickly removed and another installed using present-day casting procedures.

FIG. 5 is a preferred embodiment realizing all of the results of FIG. 3 but featuring a much simpler construction. In this embodiment, a simple toroidal device 50 permits molten metal to flow through the combined magnetic and electric fields to force contaminant particles 51 to the periphery of the flowing molten metal. Upon exiting the toroidal cavity, the main stream of molten metal 52, depleted in contaminant particles 51, flows into a tundish 53 via a shroud tube 54 (commonly used in the steel industry). Separate tubes 55 outside of the main shroud tube 54 accept the metal from the outer circumference of the toroid and send the fraction skinned-off therefrom to the slag layer 56 normally covering the molten metal in the tundish 53.

Figure 7:
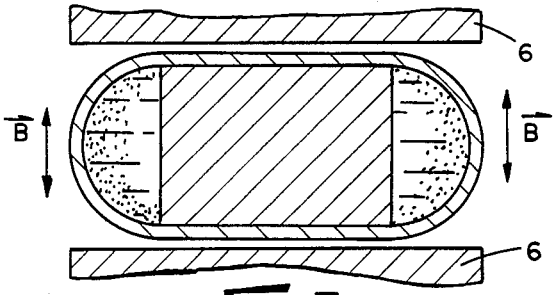
FIG. 7 is a cross sectional view taken along 7—7 in FIG. 5.
Figure 8:
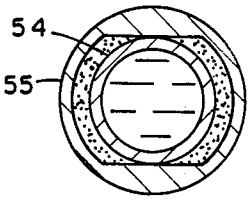
FIG. 8 is a cross sectional view taken along 8—8 in FIG. 5.

As shown in FIG. 7, which is a sectional view along line 7—7 in FIG. 5, the device 50 is disposed between ac magnet pole faces 6 to impart the magnetic B field which alternates between pole faces 6 and through the torus (into the paper in FIG. 5). The magnetic field interacts with the induced current $\vec{J}$ which alternates in a circular path around the torus as shown in FIG. 5 to produce a radially inward force $\vec{F}$ on the molten metal within the torus as indicated by the arrows in FIG. 5.

The cross section shown in FIG. 7 is for illustration purposes only, and it may be desirable to modify the interfacial surface contour between the separator body and the metal flowing therethrough in order to reduce or eliminate the rotational forces inherent in MHD systems which may produce an undesirable stirring of the molten metal.

The unique features of this device are: (a) the ability to apply a body force to the molten metal conductor in such a way that contaminants are forced to migrate rapidly either to adsorbing surfaces or to the slag layer; (b) the migration paths are short; (c) the J current is induced so that no electrical connections to the molten metal are required, and there is no grounding problem; (d) the device is easily removed and replaced using current casting procedures; and (e) the device is compact and strong.

The device can be used wherever molten metals have to flow from one point to another. Since contamination can occur at many points in a commercial casting operation, the device should be located as close to the final mold as possible. Since the action of the device is analogous to centrifugal action, it should be able to separate two immiscible molten metals, as long as the metals have different electrical conductivities.

As would be known to someone skilled in the art, the imposition of magnetic fields on a liquid conductor can create rotational forces within that liquid. This could create a stirring motion within the liquid that would negate the desired separation. The baffles shown in FIG. 3, and any other modification for preventing stirring, that might be required, are also included within the scope of the following claims.

The invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A device for removing contaminants from a molten metal composition, said contaminants being characterized in having less electrical conductivity than said molten metal, comprising a body of toroidal configuration having an outer wall and a toroidal cavity, said toroidal body having inlet and outlet ends adapted to receive and discharge a stream of said molten metal composition and means for applying a magnetic field to said molten metal composition within said toroidal cavity which magnetic field simultaneously induces an electric current which flows perpendicular to said magnetic field so as to impose a force on said molten metal composition at right angles to a plane containing said magnetic field and current flow direction, thereby causing an increase in the apparent density of said molten metal component of said composition in the direction of said force while said contaminants contained in said composition move in a direction opposite to said imposed force.

2. The device of claim 1, wherein said magnetic field applying means is an electromagnet having pole faces for coupling to said toroidal body.

3. The device of claim 2, wherein said toroidal body further comprises baffles within said toroidal cavity of a material that will absorb said contaminants.

4. The device of claim 4, wherein said baffles are ceramic baffles.

5. The apparatus of claim 4, wherein said ceramic baffles are comprised of $Al_2O_3$ or $SiO_2$.

6. The device of claim 1, which further comprises a shroud tube inserted within the outlet end of said toroidal body of said device.

* * * * *